US009738434B2

(12) United States Patent
Fujimoto

(10) Patent No.: US 9,738,434 B2
(45) Date of Patent: Aug. 22, 2017

(54) SHEET STORAGE BOX

(71) Applicant: Hiromichi Fujimoto, Beppu (JP)

(72) Inventor: Hiromichi Fujimoto, Beppu (JP)

( * ) Notice: Subject to any disclaimer, the term of this patent is extended or adjusted under 35 U.S.C. 154(b) by 0 days.

(21) Appl. No.: 14/546,064

(22) Filed: Nov. 18, 2014

(65) Prior Publication Data

US 2015/0069081 A1 Mar. 12, 2015

Related U.S. Application Data

(62) Division of application No. 13/502,657, filed as application No. PCT/JP2010/057585 on Apr. 28, 2010, now abandoned.

(30) Foreign Application Priority Data

Oct. 23, 2009 (JP) ..... 2009-244667
Dec. 22, 2009 (JP) ..... 2009-290346

(51) Int. Cl.
*B65D 83/08* (2006.01)
*A47K 10/42* (2006.01)

(52) U.S. Cl.
CPC ..... *B65D 83/0805* (2013.01); *B65D 83/0894* (2013.01); *A47K 10/421* (2013.01)

(58) Field of Classification Search
CPC ..... B65D 83/0894
See application file for complete search history.

(56) References Cited

U.S. PATENT DOCUMENTS 1,919,605 A * 7/1933 Swallow ..... 221/44
2,826,230 A * 3/1958 Conell ..... 206/494
(Continued)

FOREIGN PATENT DOCUMENTS

CN 1640784 A 7/2005
JP 2008-195412 A 8/2008
(Continued)

OTHER PUBLICATIONS

European Patent Office, "Supplementary European Search Report," issued in European Application No. 10 82 4685, which is a European counterpart to the present application and which has a date of completion of search of Oct. 2, 2014.

*Primary Examiner* — Gerald McClain
*Assistant Examiner* — Kelvin L Randall, Jr.

(57) ABSTRACT

Conventional sheet storage boxes have problems that the sheet storage box with a sheet-fixing sheet pasted on the sheet-removing opening is wasteful from the point of view of resources and that, in the case of the sheet storage box without the sheet-fixing sheet pasted on the opening, the fixing of sheet becomes weaker as the opening itself becomes larger due to the excessively wide rim of the opening and when the rims of the opening are made too close, the rim of the opening partially becomes smaller and the resistance to remove the sheets becomes too large. To solve the above problems of the conventional sheet storage boxes, the present invention provides a sheet-removing opening by effectively forming the portion to remove the sheet easily from the opening and the portion to easily catch the sheet wherein, the shape of the rims of the opening of the sheet storage box designed to remove the sheet is formed in such a way that the movement of the sheet is reduced by adequately reducing the spatial area of the opening and the rims of the opening are converted to convex shape smooth curves to smoothly slide the sheet.

2 Claims, 14 Drawing Sheets

(56) References Cited

U.S. PATENT DOCUMENTS 3,269,593 A * 8/1966 Lodewick et al. ..... 221/63
3,685,648 A * 8/1972 Heller ..... 206/462
4,289,262 A * 9/1981 Finkelstein ..... 225/106
4,651,895 A * 3/1987 Niske et al. ..... 221/63
4,848,575 A * 7/1989 Nakamura ..... B65D 83/0805 206/449
4,877,154 A * 10/1989 Matsui ..... 221/48
4,930,385 A * 6/1990 Wilfong et al. ..... 225/106
5,024,349 A * 6/1991 Haenni et al. ..... 221/46
5,137,173 A * 8/1992 Hughes et al. ..... 221/34
5,613,608 A * 3/1997 Tronchetti et al. ..... 206/494
5,729,955 A * 3/1998 Yamada ..... 53/412
6,267,262 B1 * 7/2001 Wilner ..... 221/45
6,409,044 B1 * 6/2002 Brown et al. ..... 221/63
6,499,626 B1 * 12/2002 Julius ..... 221/63
6,554,156 B1 * 4/2003 Chong ..... A47K 10/3818 221/303
6,571,985 B2 * 6/2003 Wilkes et al. ..... 221/63
6,575,329 B2 * 6/2003 Clark ..... 221/45
6,951,292 B2 * 10/2005 Bando et al. ..... 220/254.5
D531,499 S * 11/2006 Zaidman ..... D9/434
7,530,472 B2 * 5/2009 Bitowft et al. ..... 221/62
7,665,629 B2 * 2/2010 Julius ..... A47K 10/421 221/302
8,152,021 B2 * 4/2012 Babikian ..... 221/45
2002/0040913 A1 * 4/2002 Moody et al. ..... 221/63
2002/0079322 A1 * 6/2002 Wilkes et al. ..... 221/34
2002/0190074 A1 * 12/2002 Morin ..... B65D 83/0805 221/63
2005/0199643 A1 * 9/2005 Smiley et al. ..... 221/63
2005/0263534 A1 * 12/2005 Wu et al. ..... 221/63
2005/0279756 A1 * 12/2005 Bitowft et al. ..... 221/45
2005/0279757 A1 * 12/2005 Bitowft et al. ..... 221/45
2007/0215631 A1 * 9/2007 Bendor et al. ..... 221/63
2007/0215632 A1 * 9/2007 Bendor et al. ..... 221/63
2007/0257052 A1 * 11/2007 Bendor et al. ..... 221/45
2009/0289078 A1 * 11/2009 Melin et al. ..... 221/45

FOREIGN PATENT DOCUMENTS

JP 4216896 B1 1/2009
JP 2009-220859 A 10/2009

* cited by examiner

SHEET STORAGE BOX

CROSS REFERENCE TO RELATED APPLICATIONS

This patent application is a divisional of co-pending U.S. application Ser. No. 13/502,657 having a §371(c)(1), (2), (4) date of May 15, 2012, which is a U.S. national stage entry under 35 U.S.C. §371 of International Patent Application No. PCT/JP2010/057585 filed on Apr. 28, 2010, which claims the benefit of foreign priority to Japanese Patent Application No. JP 2009-244667 filed on Oct. 23, 2009, and to Japanese Patent Application No. JP 2009-290346 filed on Dec. 22, 2009, the disclosures of all of which are hereby incorporated by reference in their entireties. The U.S. application Ser. No. 13/502,657 was published on Sep. 13, 2012, as US 2012/0228323 A1. The International Application was published in Japanese on Apr. 28, 2011, as International Publication No. WO 2011/048833 A1 under PCT Article 21(2).

BACKGROUND OF THE INVENTION

The present invention relates to a box-shaped sheet storage container to store any kind of dry sheet such as tissue paper, kitchen paper, cooking sheets and vinyl bags by folding back and overlapping each sheet one above the other one by one.

A conventional removing opening of a box-shaped tissue-paper storage box, made of paper and the like, includes: that in which a tissue-paper fixing sheet which is formed of a high polymer such as a plastic and which has a cut for opening at the center is pasted on the opening of the sheet storage box; that which has an excessive gap at the center of the opening and which is line symmetric or point symmetric, without the above-described fixing sheet being pasted at a sheet-removing opening; and that in which projections forming the rims of the opening are protruded to substantially the center of the opening and which prevents smooth removal of the tissue paper.

Furthermore, normally, the tissue paper is fixed in such a way that half of the tissue paper comes out from the opening and if that tissue paper is pulled out, the next tissue paper underneath is pulled out and is repeatedly fixed in the same way as the previous tissue paper.

Hereinafter, a line formed by folding the tissue paper is considered as a folded line and as illustrated in (1') of FIG. 1, the edge of the next tissue paper parallel to the folded line is considered as a joint line and when a plurality of tissue paper has been stored, the joint line and folded line are continued.

FIG. 1 is a diagram illustrating an example of a sheet wherein, (A) is a diagram illustrating an expanded sheet, (B) is a diagram illustrating a half folded sheet along the folded line (1'), (1) is a sheet, (1') is a folded line of the sheet, a dotted line circle (1R) is a portion near the right side facing the sheet and a dotted line circle (1L) is the portion near the left side facing the sheet.

Conventionally, two-ply tissue placed on top of each other is considered as one sheet. Furthermore, conventionally there are various methods of folding the tissue paper such as a one time folding method or a two time folding method, and the size of each folded side of the tissue paper and the position of the folded line is not always uniform. The shape of the tissue paper is arbitrarily determined by a manufacturer, and the tissue paper comes in many kinds of shapes.

FIG. 2 is a diagram of a conventional tissue-paper storage box seen from obliquely upward wherein, (2) is a surface on which the tissue paper storage container has a removing opening, (3) is the tissue-paper removing opening obtained after detaching a top lid along the perforated line, (2') is the top lid removed from (3), (A-A') is a breadth of the storage box, (B-B') is a length of the storage box, (C-C') is a height of the storage box and (d) is a portion near the center of the opening. In a further description, these will also be used as the breadth of the box, length of the box, the height of the box and the portion near the center of the opening.

FIG. 3 is a diagram illustrating the is tissue-paper removing opening wherein, (2) is a surface of the storage box with the tissue-paper removing opening, (a-a') is a line passing through the center of the opening which is parallel or substantially parallel to the folded line (I') of the sheet, (3'*a*) at the top and bottom are the rims of the opening present at the line symmetric position at the time of rotating them by considering (a-a') as an axis and (3'*b*) is the rim of the opening perpendicular to (a-a') as well as the rim of the opening present at the line symmetric position at the time of rotating it by considering (a-a') as the axis.

As explained in the preceding paragraph 0008, (a-a') is a straight line passing through the center of the opening which is parallel or substantially parallel to the average folded line of sheets from the sheets stored to be removed from the opening. However, (a-a') is synonymous with (a-a') of FIG. 3 in the following paragraphs and the following figures as well. Furthermore, the straight line passing through the center of the opening perpendicular to (a-a') is considered as (b-b') and also used in the explanations below.

Paragraph 0011 to 0013 and FIG. 4 mentioned below explain the portion of the sheet to be pulled out, to which force is likely to be applied, paragraph 0014 to 0015 mentioned below explain the size of a projection, paragraph 0016 to 0017 and FIG. 5 mentioned below explain the positional relationship between the storage box and the opening and paragraph 0018 to 0021 mentioned below explain the size of the opening.

FIG. 4 is an example illustrating a case of pulling out a tissue paper from the opening of the sheet storage box wherein, (x) is a hand pulling out the tissue paper, (e) and (e') illustrate the portions of the tissue paper to which force from the hand (x) is likely to be applied, (e) is the portion to which force is likely to be applied at the time of beginning to remove the tissue paper, in other words, at the time when half of the tissue paper is lying inside the storage box, (e') is the portion to which force is likely to be applied at the time of continuous pulling out, (e) and (e') are the portions where wrinkled strings are inserted into the tissue paper at the time of pulling out and there are single or a plurality of places generating a resistance near the string caused by friction at the tissue paper and opening.

At the time of beginning to pull the tissue paper, a resistance is generated near (e), which is nearest to the opening, just below the hand and as the tissue paper comes out of the storage box, the resistance with the opening shifts to the portion near both ends of the tissue paper and the shape of the string at that point in time becomes triangular having an apex near the hand.

Furthermore, at the time of pulling out the tissue paper, if the hand holding the tissue paper moves to the right or left, an apical position of (e) and (e') also moves to the right or left.

As regards the size of the projection formed at the opening, when the projection is small or the width of the projection is narrow and sharp, it is easy to lose the smoothness of the tissue paper at a portion which contacts the rims of the opening due to an effect similar to the effect of spiked shoes depending on the portion of the opening wherein the projection is provided.

Furthermore, if a sharp projection exists at the position near (a-a'), it easily gets caught on a joint line of a newly appearing tissue paper and while pulling out the tissue paper, since the next appearing tissue paper lies over the pulling out tissue paper, if the joint line of the next tissue paper lies on the portion of the pulling out tissue paper where the largest force is applied, the tissue paper can easily fall into the storage box by getting caught.

FIG. 5 is an example illustrating the tissue-paper storage box wherein, (A) is a diagram of the tissue-paper storage box seen from obliquely upward, (B) is a cross sectional diagram of the storage box cut by a straight line parallel to (b-b'), (s) is the line on the surface with the opening parallel to (b-b'), (s) is the line passing through the apex of the projection of the opening, (t) intersects (s) at a right angle wherein, (t) and (s) become one straight line when the storage box is cut open and made flat.

In (B) of FIG. 5, if the angle formed by (s) and (t) is a right angle, the length of (f) is nearly equal to the square root of the sum of the square of (s) and square of (t), however, if (f) is shorter than the half of the length of the sheet, some portion of the sheet can come out of the opening and the sum of (s) and (t) become longer than the length of (f). If the length of the sheet is longer than the sum of (s) and (t), then "Sheet length >(f)" is established and although it is the last remaining sheet in the storage box, only the portion equal to the length of the sheet comes out from the opening.

As regards the structure of the projection in the opening, when pulling out a tissue paper, as the apex of the projection of the opening moves to the position away from the (a-a') of the opening, the space of the opening becomes wider and it is hard to abut on the joint line of the next appearing tissue paper.

Furthermore, if the apex of the projection of the opening is near (a-a') of the opening, the space forming a gap of the opening becomes narrow and the joint line of the next appearing tissue paper abuts on the apex of the opposite projection when appearing from the gap at that instant.

In other words, when the apex of the projection forming the opening is at the center of the opposite facing opening, the space between the two apexes of the opposite facing projections gets closer if the location to place the projection is not taken into consideration and the space of the opening becomes narrow, and as a result the probability of the tissue paper falling into the storage box becomes higher.

Furthermore, in a rectangular parallelepiped storage box with a long side and a short side, the long side becomes the straight line parallel or substantially parallel to the (1') and (a-a').

The paragraph 0023 to 0032 mentioned below explain the conventional common sheet storage box of FIG. 6 to FIG. 9.

FIG. 6 is a diagram illustrating an example of the conventional tissue-paper storage box seen directly from above wherein, (4) is a fixing sheet pasted near the opening similar to (3) of FIG. 2, (5) is a crosswise cut (slit) provided in (4) to function as the opening for removing and fixing the tissue paper.

FIG. 7 is a diagram illustrating an example of the conventional tissue-paper storage box seen from above without a fixing sheet pasted on the tissue-paper removing opening wherein, (6) is the projection provided in (3) to fix the tissue paper, (3) is the line symmetric portion provided above and below the tissue-paper removing opening for fixing the sheet by the projection.

However, according to a method of fixing or removing the tissue paper illustrated in FIG. 7, as the protruding projection is small with a very sharp curve forming the projection and a position held at the time of pulling out the tissue paper is not always at the center, if the tissue paper is held above the projection, there is a possibility of the paper falling into the storage box due to the joint line of the next appearing tissue paper getting caught on the portion where the projection is overlapped with the portion where the strength is concentrated at the narrow range of the tissue paper.

FIG. 8 is a diagram illustrating an example of the conventional tissue-paper storage box without the fixing sheet pasted on the tissue-paper removing opening seen from above wherein, the upper and lower portions of the lateral opening (3) have become narrower in shape by the projection (6), as viewed toward the outer side. Due to this structure, a moving range of the tissue paper is reduced and the tissue paper is fixed to the opening by using a repulsive force when the tissue paper tries to restore to a flat shape.

However, according to the method of removing or fixing the tissue paper as illustrated in FIG. 8, at the time of pulling out the tissue paper, the next tissue paper is pulled out in such a way that it is placed above the tissue paper which is being pulled out from the storage container; however, as mentioned above, at the time of beginning to pull the tissue paper, the next appearing tissue paper falls into the storage box as the apex of the projection gets caught at the portion to which force is likely to be applied near the joint line where the next appearing tissue paper has reached.

According to the preceding paragraph 0027 mentioned above, if the amount of the tissue paper in the storage box decreases, the position of the next appearing tissue paper becomes relatively lower as compared to the position of the rim of the opening and thus the probability of tissue paper falling into the storage box becomes higher as the joint line of the tissue paper can easily abut on the projection of the rim of the opening.

Furthermore, the tissue paper from the box illustrated in FIG. 8 is removed from the wider openings on the right and left of the projection. At the time of removing the sheet, since the paper is drawn by inserting a finger from either the left or right side hole, it is obviously more difficult to take the paper out, because it is not possible to take the paper out evenly from the right or left, than a case where the center and its surrounding area are drawn, and the opening has to be reduced to some extent to fix the sheet, otherwise it is difficult to remove the tissue paper.

FIG. 9 is a diagram illustrating the conventional tissue-paper storage box without the fixing sheet pasted at the tissue-paper removing opening seen from above wherein, (6') is the projection provided in (3) for fixing the tissue paper, (6") is the projection provided in opening (3) for fixing the tissue paper by narrowing its moving range.

However, according to FIG. 9, the tissue paper is fixed by narrowing the moving range but, similar to the preceding FIG. 8, the opening has a shape having the apex of the projection near its center, and the same problem described above occurs.

Furthermore, in conventional sheet storage boxes, the projection is raised by inserting the folded line near the bottom of the projection opposite the apex of the projection but, if the projection is raised, the resistance at the time of removing a sheet is reduced and when a sheet falls into the storage box, it takes quite a bit of effort to pull it out since the projection abuts on the finger and if the shape of the projection is complicated, it requires even greater effort.

Paragraph 0034 to 0047 and FIGS. 10 to 16 mentioned below explain the tissue-paper storage box with a point symmetrical opening.

If the projection is placed at the point symmetric position of the opening, although the sheet is pulled from the front side of the sheet or back side of the sheet which is present above the opening, a wide space and narrow space are generated in the opening space of either the right side ((1R) of FIG. 1)) or left side ((1L) of FIG. 1) of one sheet and it is possible to provide the portion that easily makes contact with the opening and the portion that easily appears from the opening on one sheet. Furthermore, if the shape of the projection is a smooth protruding curve, the sheet to be pulled out can be easily made to slide.

FIG. 10 is a diagram illustrating an example of a sheet-removing opening wherein, (7) is the sheet-removing opening which is of a point symmetric shape and nonlinear symmetric shape with respect to the (a-a') axis, (7*a*) is the long side of the opening and (7*b*) is the short side of the opening.

Furthermore, the opening illustrated in FIG. 10 can be considered to be of the shape such that it can be moved in the clockwise or counterclockwise direction by considering the center of the opening as the axis and the length or inclination of (7*a*) and (7*b*) can be considered to be changed.

FIG. 11 is a diagram illustrating an example of the sheet-removing opening, the shape of which has become line symmetric with four sides of equal length illustrated in FIG. 10 wherein, the opening has a point symmetric shape and the rim of the opening with an equal length of upper and lower (7R) and upper and lower (7L) is line symmetric with respect to (a-a').

FIG. 12 is a diagram illustrating an example wherein, the rim of the opening placed point symmetric with respect to the point has formed a curve on the basis of FIG. 11 and is a point symmetric opening with nonlinear symmetry.

Similar to FIG. 10, the opening illustrated in FIG. 11 and FIG. 12 may be set in such a way to rotate it in the clockwise direction or counterclockwise direction by considering the center of the opening as the axis and the length or inclination of the rim of the opening can be changed.

FIG. 13 is a diagram illustrating an example of the sheet-removing opening wherein, an intersection of (a-a') and (b-b') is (d), (d') is the circle near the center of the tissue-paper removing opening, an opening (7) has a depression (10) between the rims of the opening (9) and outside from the apex of the projection (8), the line symmetric rim of the opening has the nonlinear symmetric shape (11) by considering (a-a') of (8) as the axis with the point symmetric sheet-removing opening.

Similar to the above opening, the opening having the shape so that the opening can be rotated in the clockwise direction or counterclockwise direction by considering (d) as the axis can be considered.

FIG. 14 is a diagram illustrating an example of the projected portion of the sheet-removing opening wherein, (12) shows that the apex of the projection does not exceed (a-a'), (12') shows that the apex of the projection is of the same height as that of (a-a') and (12") shows that the apex of the projection exceeds (a-a').

If the shape of the opening is point symmetric with nonlinear symmetry with respect to (a-a'), then a projection that exceeds (a-a') can be used.

FIG. 15 is a diagram illustrating an example of the sheet-removing opening wherein, the opening is such that the height of the projection is perpendicular to the folding line of the sheet i.e., perpendicular to (a-a') and the projection is formed from the two straight lines (13) and (13').

Furthermore, the opening illustrated in FIG. 15 can be considered to be the opening the same as mentioned above wherein, the opening is set at the position to rotate it in the clockwise direction or counterclockwise direction.

FIG. 16 is a diagram illustrating an example of a cover made of a cloth to cover the sheet storage box wherein, (14) is the cover main body, (14') is the sheet-removing opening provided on (14), and there is an opening designed to insert the storage box with rubber forming a ring at the bottom of (14). When the storage box is inserted at any position from the opening designed to insert the storage box, rubber of the opening designed to insert the storage box is shrunk and the cover is fixed but, many other styles also exist.

According to the point symmetric opening with nonlinear symmetry, the spatial gap between the projection of the opening and the rims of the opening opposite the projection across (a-a') becomes wide and the sheet holding power by the rims of the opening becomes weak since the sheet moves too far away from the rims of the opening.

Hereinafter, "paragraph 0049 explains Japanese Published Unexamined Patent Application No. 2008-137686," "paragraph 0050 to 0053 explain Japanese Published Unexamined Patent Application No. 2003-040361," "paragraph 0054 explains Japanese Published Unexamined Patent Application No. 2005-225563," "paragraph 0055 to 0057 explain Japanese Published Unexamined Patent Application No. 2006-016069," "paragraph 0058 explains Japanese Published Unexamined Patent Application No. 2006-027648," "paragraph 0059 and 0060 explain Japanese Published Unexamined Patent Application No. 2008-162623," "paragraph 0061 and 0062 explain Japanese Published Unexamined Patent Application No. 2002-104549" and "paragraph 0063 to 0065 explain Domestic Republication WO2005/108238."

In Japanese Published Unexamined Patent Application No. 2008-137686, it has been explained that a pair of projections are provided near the point symmetric position of the opening and the projections allow the sheets to be fixed and smoothly removed. However, the form mentioned in Japanese Published Unexamined Patent Application No. 2008-137686 has drawbacks mentioned in the preceding paragraph 0047 hereof wherein, the opening has only single direction inclination with respect to the front side or back side of the sheet and the opening needs to be extremely inclined to reduce the space of the opening. When the cover made of cloth, etc., is used to cover the sheet storage box as illustrated in FIG. 16, the central portion of the sheet becomes difficult to remove from the opening and the sheets again slide and fall into the storage box due to the poor method of removing the sheets.

In Japanese Published Unexamined Patent Application No. 2003-040361, it has been explained that the two pairs of flaps are provided wherein, these two pairs of flaps are intended to be different in shape when facing opposite each other and similar in shape when placed diagonally and forms the point symmetry with respect to the center point of the opening in the planar view (Refer to page 4, left column, line 1 to line 5, and FIG. 2 of the publication). Furthermore, Japanese Published Unexamined Patent Application No. 2003-040361 also explains that, the space to insert the finger tips is formed by a half space to insert the finger tip positioned at one side and a half space to insert the finger tip positioned at the other, side across a horizontal central line passing through the center of the opening and the half spaces to insert the finger tips are formed by displacing them by a specified distance respectively toward alternate sides (Refer to the page 4, left column, line 15 to line 20 of the publication).

According to Japanese Published Unexamined Patent Application No. 2003-040361, it is understood that picking sheets one after another needs to be made easy by providing different projections for the opening of a wet tissue storage box wherein, a convex surface and a concave surface face each other and elastic deformation must be made easy by partially thinning the projection to pull out the sheets easily, since wet tissues tend to stick to each other because of moisture and also tend to slip at the opening of the storage box because of moisture.

In other words, according to Japanese Published Unexamined Patent Application No. 2003-040361, a total two pairs of projections having different shapes are formed at two opposite corners of the opening wherein, one pair of projections has a sharp angle and another pair of projections has a depression. The main method for fixing the sheets is determined by partially pushing the sheet by the projections and since the four projections are not formed by convex curves, tissue paper cannot be fixed or moved without rendering too much resistance to the tissue paper.

Furthermore, as regards the finger tip insertion space present in the opening with the flap mentioned in Japanese Published Unexamined Patent Application No. 2003-040361, the opening with a flap mentioned in the "prior art in the specification and FIG. 11 of Japanese Published Unexamined Patent Application No. 2003-040361" also has the finger tip insertion space and it is understood that the finger tip insertion space mentioned in Japanese Published Unexamined Patent Application No. 2003-040361 is present only in the opening with a flap mentioned in Japanese Published Unexamined Patent Application No. 2003-040361.

In Japanese Published Unexamined Patent Application No. 2005-225563, it has been mentioned that the sheet-removing opening has a slit and the shape is point symmetric with nonlinear symmetry. However, if the sheet is inserted too much into the slit depending on the shape, the sheet is torn at the time of removing and the space for removing the sheets become too large if a slit is not used and this resulted in a drawback similar to the drawback mentioned in paragraph 0047 hereof.

In Japanese Published Unexamined Patent Application No. 2006-016069, it has been mentioned that "the slit on the nonlinear line consists of a substantially circular curve formed substantially at the center of the upper plate and a straight line of specified length toward a substantially corner portion of the upper plate from both ends of the curve (Refer to page 3, line 50 to page 4, line 3 of the publication). However, this opening has a shape such that it always comes in contact when projections are formed on the same plane.

In Japanese Published Unexamined Patent Application No. 2006-016069, it has been mentioned in paragraph 0027, page 6 of the publication that the flap is closed when the tissue paper is pulled out and it has been mentioned in paragraph 0029, page 7 of the publication that if the flap loses resistance it does not work properly. There are two apexes of projections on one side rim and one apex on the opposite side rim and if the flap does not work properly, the tissue paper may get caught near the apex of the projection.

In Japanese Published Unexamined Patent Application No. 2006-016069, it has been mentioned in paragraph 0025, page 6 of the publication that the flap is slightly opened and fingers are inserted inside. However, the flap of the opening is like a covering lid and the flap may get in the way of fingers at the time of removing tissue paper in the storage box which makes it difficult to remove the tissue paper. Care must be exercised so as not to open the flap excessively and lose return of the flap.

According to Japanese Published Unexamined Patent Application No. 2006-027648, a pair of point symmetric projections is present near the center of the opening; however, the tissue paper must be removed from either the right opening space or left opening space due to the narrow center of the opening. Furthermore, the central projection may hinder movement of the tissue paper.

In Japanese Published Unexamined Patent Application No. 2008-162623, it has been mentioned on the page 2, claim 1, line 10 to line 12 of the publication that "the rim of the removing opening has . . . a pair of first rim portions facing each other across a longitudinal central line."

In other words, the opening is such that, at the time of beginning to pull out the sheets from the storage box, the next sheet is likely to get caught as the apex of the projection is present near the portion to which force is likely to be applied on the sheet and since the wide finger tip insertion space cannot be provided in the center of the opening as it is not point symmetric, it requires quite a bit of effort to insert fingers in the storage box from the opening when the sheet falls into the storage box.

In Japanese Published Unexamined Patent Application No. 2002-104549, it has been mentioned on page 2, left column, claim 1, line 10 to line 12 of the publication that "Each rim portion facing the opening, has a plurality of curve shape convex portions formed by flat surfaces projecting toward inside the opening" and according to the diagram, it is understood that the plurality of projections present in the opening are present at the position the same as or similar to the line symmetry.

In other words, if there are two pairs of projections opposite each other with acute angles, the shape similar to or the same as that mentioned in the preceding FIG. 7 is formed and the same problems as that mentioned in the preceding FIG. 7 occur. If there are more than two pairs of projections, although there is no problem with wet sheets, the movement of the next appearing dry tissue paper is readily hindered.

In Domestic Republication WO2005/108238, it has been mentioned on page 2, claim 1, line 7 to line 11 of the publication that "the removing opening has . . . a pair of supporting portions to support . . . and the rim of each of the support portions is facing toward the center in the longitudinal direction and forms a uniform bulge with a gentle curvature." From this description it is understood that, this portion is the same as or similar to the projections described in FIG. 8 and FIG. 9.

Furthermore, in Domestic Republication WO2005/108238, it has been mentioned on page 2, claim 8 and FIG. 7 of the publication that, a pair of projections has a wavy line shape and this portion has problems the same as or similar to the problems described in paragraph 0061 and 0062 hereof.

Furthermore, in Domestic Republication WO2005/108238, it has been mentioned on page 2, line 12 to line 14 of the publication that "can be raised . . . of the rim of the supporting portion" and it has been mentioned on page 2, line 48 to line 50 of the publication that "at the outer location in the width direction of the rim of the supporting portion, . . . , the supporting portion can be raised upward respectively by considering a compressed line designed for raising as the raising line." From this description it is understood that although it is indicated to raise the projection, it takes quite a bit of effort to take the tissue paper since the projection abuts on a hand or a finger when the tissue paper decreases in number and falls into the storage box if the projection is raised.

As mentioned above, although pasting the sheet-fixing sheet on the sheet-removing opening is suitable for removing the sheets, it is wasteful from the point of view of resources.

As mentioned above, when the sheet-fixing sheet is not pasted on the opening of the sheet storage box, the fixing of sheets becomes weaker as the opening itself becomes larger due to the excessively wide rim of the opening and when the rims of the opening are made too close, the rim of the opening partially becomes smaller and the resistance to remove the sheets becomes too large.

In order to solve the above-mentioned problems of the conventional sheet storage boxes, an object of the present invention is to effectively configure a portion by which the sheet can be stuck smoothly and a portion where the sheet can be easily taken from the opening by making the shape of the rim of the sheet-removing opening of the sheet storage box such that the movement of the sheet is reduced by adequately reducing the spatial area of the opening and converting the rim of the opening to a convex shape smooth curve so as to slide the sheets easily and by changing the height of the projection of similarly shaped face-to-face rims of the opening of two pairs of main rims of the opening at opposite corners.

SUMMARY OF THE INVENTION

To achieve the object mentioned above, there is provided a sheet storage box of the present invention, wherein two pairs of smooth convex shape curved opening rims are provided at corners by considering the center of the opening as a center point, wherein the two pairs of the opening rims are set one after the other and the height of the apexes of the opening rims present at the corners is the same or substantially the same and the height of the apexes of the adjacent or opposite opening rim is different, an open space is formed as a result of constant absence of the opening rim or lid at three places i.e., within a circle of 3 mm in diameter at the center of the opening and within the circle of 2 mm in diameter at both ends of the opening, wherein the two pairs of smooth convex shape curved opening rims are formed to be positioned in the spaces at the three places, the opening rims forming the space at both ends of the opening are the depressions placed opposite each other across the convex shape curved opening rims and the rims of the opening forming the space including the center of the opening have depressions between the adjacent convex shape curved rims of the opening present at both sides and these depressions are placed opposite each other at the corners of the rims of the opening forming the space including the center of the opening, and the opening rim is provided which takes the shape of nonlinear symmetry when the opening is rotated at 180 degrees by considering the straight line passing through the center of the opening, which is parallel or substantially parallel to the average folded line of sheets stored to remove sheets from the opening, as the axis and takes the shape of point symmetry or substantially point symmetry when the opening is rotated at 180 degrees by considering the center of the opening as the axis.

Furthermore, the sheet-removing opening of the sheet storage box of the present invention is characterized in that the depressions opposite each other located at the corners of the opening rims forming the space including the center of the opening as mentioned in the preceding paragraph 0070 are depressions formed by joining the adjacent smooth convex shape curves by using the folded line shape or folded convex shape curves.

The sheet-removing opening of the sheet storage box according to the present invention is characterized in that, in the depressions opposite each other located at the corners of the opening rims forming the space including the center of the opening as mentioned in the preceding paragraph 0070, a depression being depressed by 1 cm or more in the direction parallel to the folded line of a sheet is absent at the lower side than the center rim of the opening of smooth convex shape curved opening rims which support the sliding of the sheet.

Furthermore, the sheet-removing opening of the sheet storage box of the present invention is characterized in that the depressions opposite each other located at the corners of the opening rims forming the space including the center of the opening as mentioned in the preceding paragraphs 0070 to 0072 comprise one or a plurality of pairs of convex shape curved projections shorter than the height of the apexes of the convex shape curved opening rims present at both sides at the opposite corners of the depression forming the space including the center of the opening.

Furthermore, the sheet-removing opening of the sheet storage box of the present invention is characterized in that the pair of depressions which forms the opening rims outside the circle of 2 mm in diameter present at both ends of the opening as described in the preceding paragraph 0070 are depressions themselves having the shape including the concave shape curve.

According to the operation as mentioned in the preceding paragraph 0070, the curved opening rims become the same kind of smooth convex shape and as there is no retroflexion of the depression in the projected portion used to slide the sheet, the projected opening rim and sheet come in contact with each other and the resistance can be decreased. There does not exist a large gap between the projections and the depressions of the opening rims opposite the projection, and therefore, the movement of the sheet can be suppressed at the time of pulling out the sheet. The sheets can be fixed smoothly by reducing the space pushed by the opening.

According to the operation as mentioned in the preceding paragraph 0071, as the joint portion provided through the contact between adjacent smooth convex shape curved opening rims suddenly becomes narrow, the sheets get stuck in the depression at the time of removal.

According to the operation as mentioned in the preceding paragraph 0072, as the depression present at the lower side than the center rim of the opening of smooth convex shape curved opening rims, which supports sliding of the sheet, does not have a depression being depressed by 1 cm or more in the direction parallel to the folded line of a sheet, the sheet is prevented from being guided toward an opening not intended.

According to the operation as mentioned in the preceding paragraph 0073, while pulling the sheet to the opening rim, a small folding line nearly similar to the shape of the projection can be put into the sheet by using the smooth projections on both sides and a small subordinate projection between them.

According to the operation as mentioned in the preceding paragraph 0074, the pair of depressions present at both ends of the opening itself are the depressions of shape including the concave shape curve due to which the ends of the sheet can be fixed smoothly.

According to the effect of the preceding paragraph 0070 mentioned above, the sheet can be pulled out smoothly and it can be fixed in such a way that it is difficult for the sheet to fall into the storage box.

According to the effect of the preceding paragraph 0071 mentioned above, the sheet can be pulled out in such a way that the sheet gets caught in the opening.

According to the effect of the preceding paragraph 0072 mentioned above, the movement of the sheet can be suppressed as the sheets are prevented from being guided toward an opening not intended.

According to the effect of the preceding paragraph 0073 mentioned above, as the small folding line nearly similar to the shape of the projection can be put into the sheet by using the smooth projections on both sides and a small subordinate projection between them, the sheet can be raised easily.

According to the effect of the preceding paragraph 0074 mentioned above, as the shape of both ends of the opening is made into the shape including the concave curve shape, the drawback is eliminated that, if both ends of the opening are an acute angle, the sheet gets stuck and the movement of the sheet is hindered, and the sheet can be caught smoothly in the depression due to the restoring force of the sheet itself.

DETAILED DESCRIPTION OF THE INVENTION

Embodiments of the present invention will be described below on the basis of FIG. 17 to FIG. 33.

FIG. 17 is a diagram illustrating an example of sheet-removing opening rims of line symmetric shape by considering (a-a') as the axis to explain the present invention wherein, (15) is the surface of the sheet-removing opening of the sheet storage box, (16) is the sheet-removing opening, (17) is the rim of the opening formed into a smooth convex shape curve, (18) is the depression of the opening rims forming the space including the center of the opening and (19) are the depressions formed at both ends of the opening.

FIG. 17 shows an opening having two pairs of the opening rims with opposite convex shape curves of (17) and the height of the apexes of the opposite convex shape projections is the same. However, it does not have a shape with which only from one side the sheet can be easily removed from the opening and at the other side the sheet can be fixed easily, due to which the fixing of the sheet becomes loose.

FIG. 18 is a diagram illustrating an example of the sheet-removing opening of the present invention wherein, the rim of the opening is at the position after rotating the preceding FIG. 17 in a counterclockwise direction, (15') is the surface of the sheet-removing opening of the sheet storage box of the present invention, (16') is the sheet-removing opening of the present invention, (17') is the convex shape curved rim of the opening of the present invention which is at a high level as compared to (17"), (17") is the convex shape curved rim of the opening of the present invention which is at a low level as compared to (17'), (18') are the depressions of the present invention forming the space including the center of the rim of the opening, (19') are the depressions of the present invention formed at the opposite ends of the rims of the opening.

The opening can also be formed by rotating the opening illustrated in FIG. 17 in a clockwise direction. There is no limit on the styles of the opening as long as the conditions of the present inventions are fulfilled.

FIG. 19 is a diagram illustrating an example of the sheet-removing opening of the present invention which is the same as in FIG. 18 mentioned above. However, (20) is the space with an open portion within the circle of 3 mm in diameter present at the center of the opening, (21) is the space with open portion within the circle of 2 mm in diameter present at both ends of the opening, (21) are the spaces opposite each other across the convex shape curved rims of the opening, furthermore, (20) has the depressions present between the adjacent convex shape curved rims of the opening which are present at both sides and these depressions are the spaces formed inside the depressions which are opposite each other at the corners of the rims of the opening forming the space including the center of the opening.

FIG. 20 is a diagram illustrating an example of the sheet-removing opening wherein, (22) is the depression that does not have a depression being depressed by 1 cm or more in the direction parallel to the folded line of a sheet at the lower side than the center rim of the opening of smooth convex shape curved opening rims (17') and (17") which support the sliding of the sheet. It suffices if an arrow between the dotted straight lines does not enter below (17') by 1 cm. The same applies to (17").

If (22) is large, the sheet is prevented from being guided to any direction and therefore, it is preferable that the depression entering below (17') and (17") are not present.

FIG. 21 is a diagram illustrating an example of the sheet-removing opening of the present invention wherein, (17') is the convex shape curved rim of the opening of the present invention present at a high level, (17") is the convex shape curved rim of the opening of the present invention present at a low level, (18') are the depressions of the present invention and (19') are the openings with the depressions present at both ends of the opening of the present invention.

FIG. 22 is a diagram illustrating an example of the sheet-removing opening of the present invention wherein, the opening is formed by rotating FIG. 21 in the counterclockwise direction, however, the opening can be formed by rotating it in the clockwise direction as long as the height of the projections illustrated in FIG. 21 does not become equal. There is no limit on the styles.

In FIG. 22, (23) is a step formed by (19') and (17'), (24) is a step formed by (19') and (17"). If the step is present at (17') side, the sheet can be fixed easily while the projected portion of (17') is concealed below the sheet.

FIG. 23 is a diagram illustrating an example of a portion of the sheet-removing opening as mentioned in claim 2 and claim 4 of the present invention wherein, (1) illustrated by a dotted line is the tissue paper, (25) is the depression of the present invention formed by contacting the adjacent smooth convex shape curves by using the folded convex shape curve or folded line shape curves, (26) is the curved shape projection mentioned in claim 4 which is present at a lower level than the height of (17') and (17"), (25') is the depression formed adjacent to (26), (A) is the rim of the opening mentioned in claim 2, and (B) and (C) are rims of the opening mentioned in claim 4.

By passing the sheet through the vicinity of (25) or (25'), the sheet can be inserted in the narrow portion of the opening and by considering this portion as a force point, both ends of the sheet can be moved to the end of the opening. Furthermore, due to the shape of the opening of the present invention, although the sheet has not reached (19'), it can be fixed.

Furthermore, if the count of (26) is increased too much, an adhesion of the sheet to the rims of the opening becomes poor and thus it is better to have up to about two each on the upper and lower sides.

FIG. 24 is a diagram illustrating an example of a simplified diagram when (B) mentioned in the preceding FIG. 23 has been operated wherein, (1") are the mountain fold strings formed in the sheet and the sheet can be easily raised by hollowing the space between the strings.

FIG. 25 is a diagram illustrating an example of the sheet-removing opening having (A) mentioned in FIG. 23 wherein, (25) can draw the sheet when sheets are to be pulled out.

FIG. 26 is a diagram illustrating the opening formed at a position when the sheet-removing opening illustrated in FIG. 25 is rotated in the counterclockwise direction wherein, the opening is formed in such a way that (17') is concealed below the sheet and sheet is caught from below and can be held easily.

FIG. 27 shows the sheet-removing opening including (17') and (17") illustrated in FIG. 18 as mentioned in claim 2.

FIG. 28 is a diagram illustrating an example of the sheet-removing opening with (B) illustrated in FIG. 23.

FIG. 29 is a diagram illustrating the opening formed at a position when the sheet-removing opening illustrated in FIG. 28 is rotated in a counterclockwise direction.

FIG. 30 is the sheet-removing opening including (17') and (17") illustrated in FIG. 18.

FIG. 31 shows a diagram illustrating an example of the sheet-removing opening with (C) illustrated in FIG. 23.

FIG. 32 is a diagram illustrating the opening formed at a position when the sheet-removing opening illustrated in FIG. 31 is rotated in a counterclockwise direction.

FIG. 33 shows the sheet-removing opening including (17') and (17") illustrated in FIG. 18.

As mentioned above, according to the embodiments of the present invention, the sheets which are effectively fixed and smoothly removed can be obtained.

The embodiments mentioned above are described to explain the present invention and according to the claims of the present invention, there is no limit on the types of the embodiments such as shape, material and structure.

EXAMPLES

FIG. 34 is a diagram illustrating an example of a top lid provided on the sheet-removing opening of the present invention wherein, (27) is the top lid which can be detached from the vicinity of to the center of the opening by dividing into half by using a perforated line, (28) is a thin portion of the top lid and (29) is a portion of the top lid with a perforated line wherein a hole can be made by inserting a finger.

The portion of (28) wherein, the top lid has become thin is made easier to move away from the surrounding perforated line by elongating the cut portion of the perforated line of (15') and the top lid is made easier to move away by completely cutting the tip portion of the acute angle portion. Furthermore, double perforated lines may be provided. There is no limit on types such as shape, interval, and number of perforated lines.

FIG. 35 shows an example of the sides which forms the storage box that can be used in the present invention wherein, (A) is a diagram of a portion of a flattened storage box seen from the front side, (B) is the cross sectional diagram of (A), (C) is a diagram wherein, right and left inner surfaces of (B) are moved closer and fold down wherein, (30) is the front side surface of the storage box, (31) is a concave shape groove set up in (30), (30') is an inner surface of the storage box and (31') is a convex shape line placed on the opposite side of (31).

The side of the storage box may be formed by just folding down the flat surface once or it may be of the shape mentioned above in the preceding paragraph 0113. Furthermore, the shape of the storage box may be rectangular parallelepiped, cube or curved shape formed by curling up the sides or corners. There are various shapes formed by a polyhedron formed of a straight surface or curved surface and there is no limit on the styles.

FIG. 36 is a diagram illustrating an example of the portion of the sheet-removing opening as illustrated in FIG. 23 with some portions changed wherein, (32) is the portion with (25) or (25') illustrated in FIG. 23 changed to a smooth concave shape, (A) is the portion with a space between (17') and (17") changed to (32), (B) is the portion with (25') changed to (32) and (C) is the portion with (25') present between (26) changed to (32).

The depression with a shape mentioned in the above (32) is not a desirable shape as the pulling force of the sheet at the time of pulling the sheet out is less.

FIG. 37 is a diagram illustrating an example wherein (25) is formed by contacting adjacent (17) mentioned in FIG. 17. In the opening of this shape, since (17) facing each other are of same height, the rims of the opening cannot be too close to (a-a') as the appearing tissue paper cannot make contact with the rims of the opening properly and therefore this is less effective as compared to the shape of the rims of the opening of the present invention.

FIG. 38 is a diagram illustrating an example of a pair of curved shape projections smaller than (17) provided between the adjacent (17) illustrated in FIG. 17 and with this shape also the effect the same as mentioned in the preceding paragraph 0117 is obtained.

FIG. 39 is a diagram illustrating an example of two pairs of curved shape projections smaller than (17) provided between the adjacent (17) illustrated in FIG. 17, and with this shape also the effect the same as mentioned in the preceding paragraph 0117 is obtained.

FIG. 40 is a diagram illustrating an example of the rims of the opening forming the spaces (19') at both ends of the opening of the present invention. Although the above-mentioned depression forming both ends of the opening of the present invention is formed by the arc shape or full arc shape curve, (A) shows the depression formed by combining the curve shape and straight line shape, (B) shows the depression formed by changing the end of the rims of the opening to the straight line shape and (C) is formed by the curved shape depression at both ends and the depression including the projection at the center.

In FIG. 40, (A) shows the effect most similar to the effect of (19) used in the explanation above.

FIG. 41 is a diagram illustrating an example of the opening of the storage box of the present invention wherein, (n) and (m) are the symbols to indicate the ratio of the width of (17') and (17"). As long as (17') and (17") fulfill the above-mentioned conditions of the present invention, the ratio of (n) and (in) may be the same or different without limiting the style.

The embodiments of the present invention are as follows.

1. As long as the tissue-paper removing opening of the present invention fulfills the conditions of the present invention, the ratio of the width of the projection running parallel to (a-a') described in claim 1 of the present invention may be the same or different without limiting the style.

2. As long as the configured location of the subordinate projection mentioned in claim 4 fulfills the conditions of the present invention, it may be at a line symmetric position or point symmetric position without limiting the style.

3. There are various styles of the formation of the opening of the present invention such as forming the opening by slightly widening the pair of depressions present on the rims of the opening forming the space including the center of the opening so that it is easy to insert the finger tips or a combination with other effective shapes may be used to form the opening.

4. A cut to tuck the sheet and convexity or concavity giving resistance to the sheet may be provided at the rims of the opening of the present invention. A valley fold line may be provided using the convexity or concavity provided in the storage box in order to easily raise the projections of the rims of the opening of the present invention. The cut may be provided on the surface of the storage box below the projection of the present invention to soften the projection itself of the present invention. A perforated line and folded line may be provided to form the projection to be raised in the storage box by tucking the portion of the storage box separated by using a perforated line near the center of the bottom of the storage box to push the sheet upward used in the storage box of the present invention. The perforated line may be provided to easily break or collapse the storage box of the present invention. The opening of the present invention may be used in the storage box with another shape and effect. Other modifications can be adopted. There is no limit on styles in which the manufacturers may combine any other effective structure or material for the opening or the storage box of the present invention.

REFERENCE SIGNS LIST

Figure 1A:
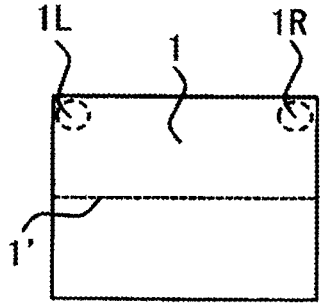
FIG. 1A is a diagram illustrating an expanded sheet.
Figure 1B:
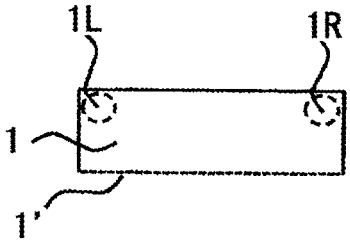
FIG. 1B is a diagram illustrating a half folded sheet along the folded line (1').
Figure 2:
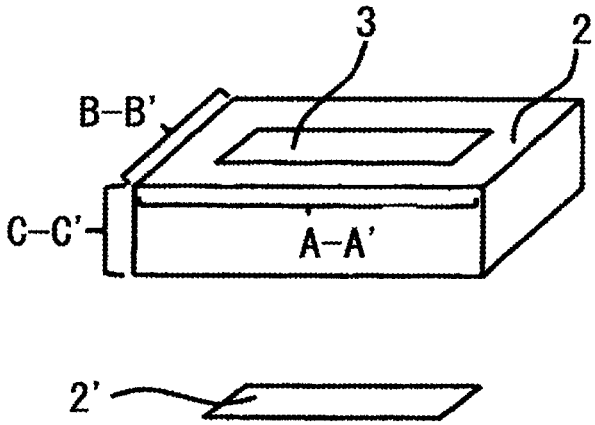
FIG. 2 is a diagram of an example of the conventional tissue-paper storage box seen from obliquely upward.
Figure 3:
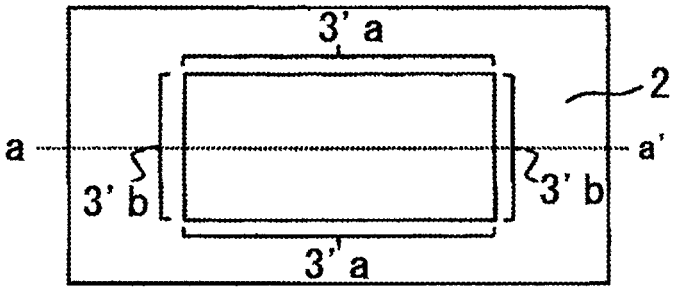
FIG. 3 is a diagram of an example of the tissue-paper removing opening.
Figure 4:
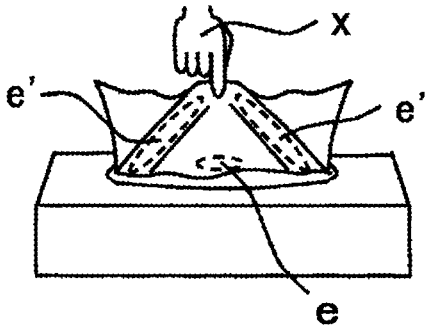
FIG. 4 is a diagram of an example when pulling out the tissue paper from the opening.
Figure 5A:
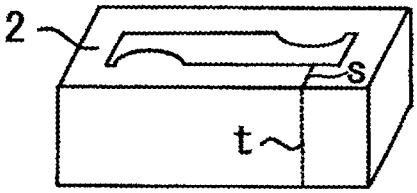
FIG. 5A is a diagram of the tissue-paper storage box seen from obliquely upward.
Figure 5B:
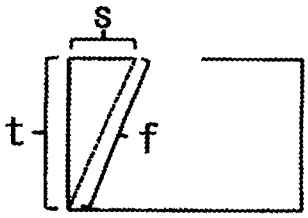
FIG. 5B is a cross sectional diagram of the storage box cut by a straight line parallel to (b-b').
Figure 6:
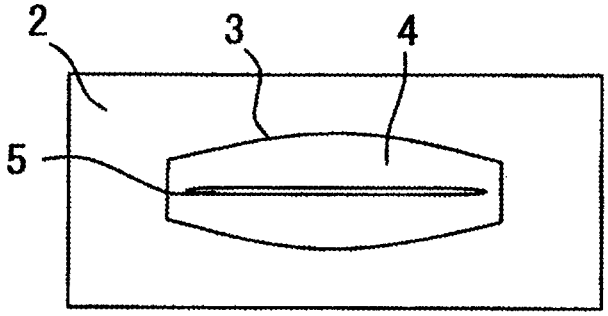
FIG. 6 is a diagram of an example of the conventional tissue-paper storage box seen from directly above.
Figure 7:
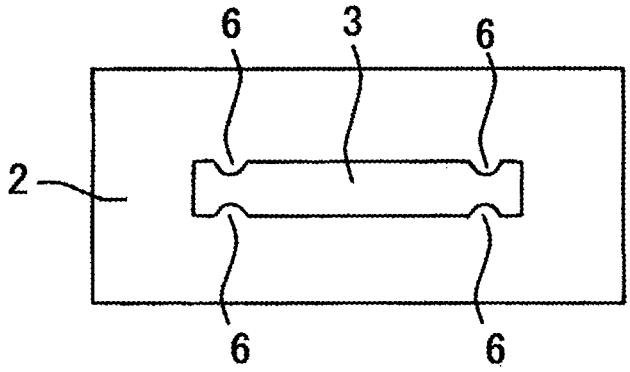
FIG. 7 is a diagram of an example of the conventional tissue-paper storage box seen from above.
Figure 8:
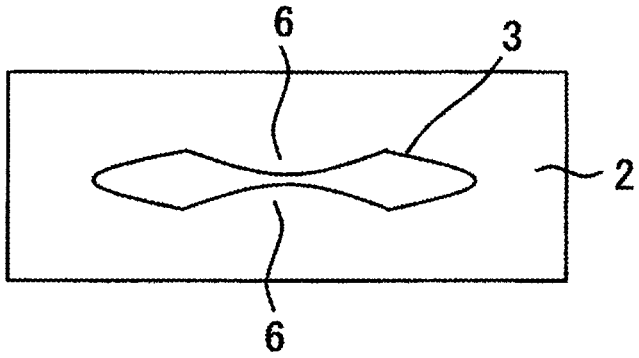
FIG. 8 is a diagram of an example of the conventional tissue-paper storage box seen from above.
Figure 9:
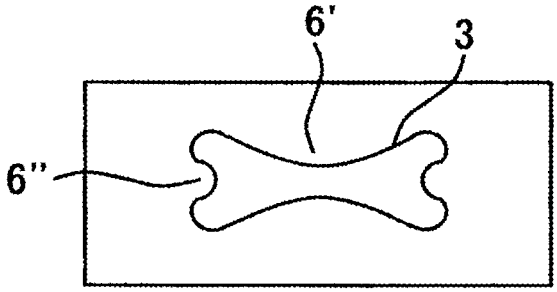
FIG. 9 is a diagram of an example of the conventional tissue-paper storage box seen from above.
Figure 10:
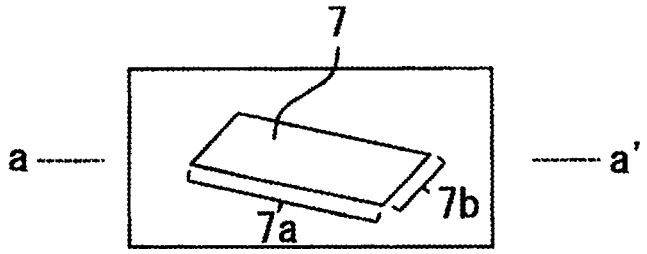
FIG. 10 is a diagram of an example of the sheet-removing opening.
Figure 11:
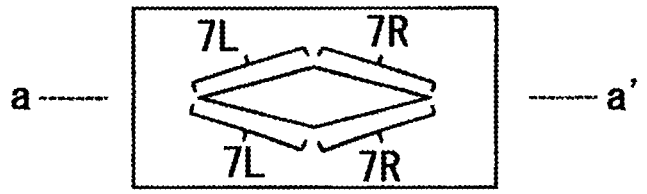
FIG. 11 is a diagram of an example of the sheet-removing opening.
Figure 12:
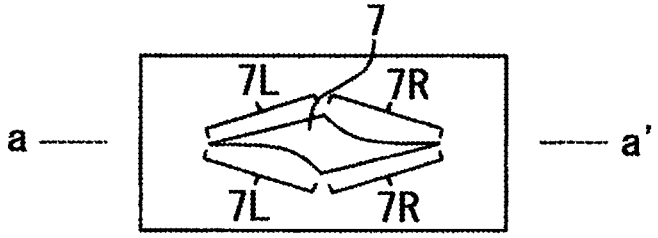
FIG. 12 is a diagram of an example of curved shape rim of the opening placed at the point symmetric position.
Figure 13:
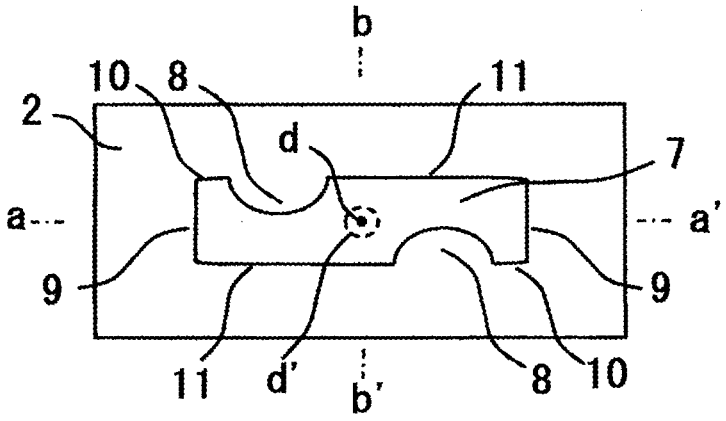
FIG. 13 is a diagram of an example of the sheet-removing opening.
Figure 14:
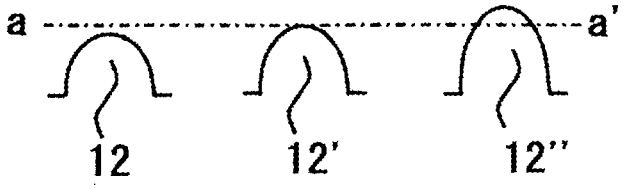
FIG. 14 is a diagram of an example of the projected portion of the sheet-removing opening.
Figure 15:
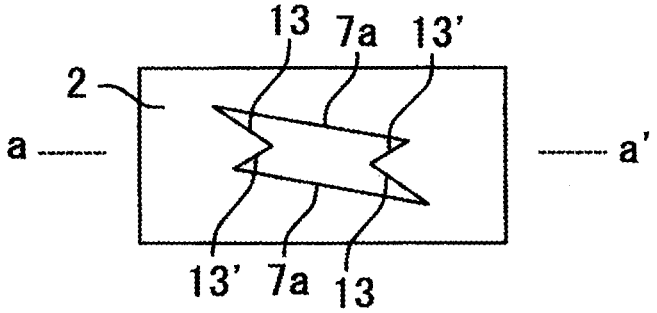
FIG. 15 is a diagram of an example of the sheet-removing opening.
Figure 16:
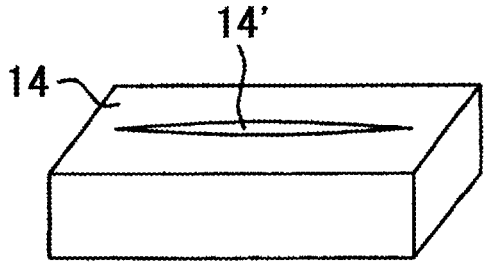
FIG. 16 is a diagram of an example of a cover made of cloth to cover the sheet storage box.
Figure 17:
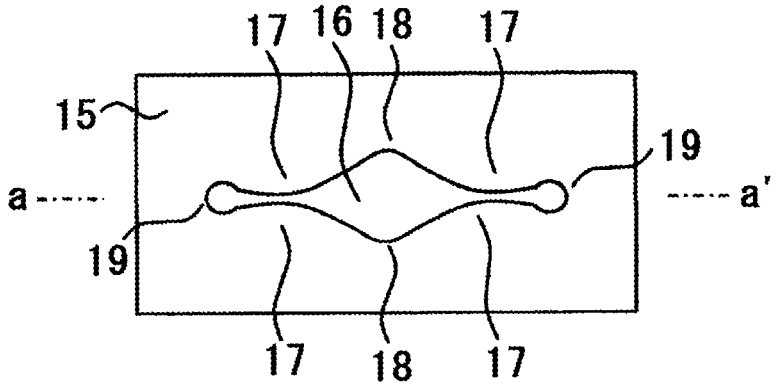
FIG. 17 is a diagram of an example of line symmetric rim of the sheet-removing opening.
Figure 18:
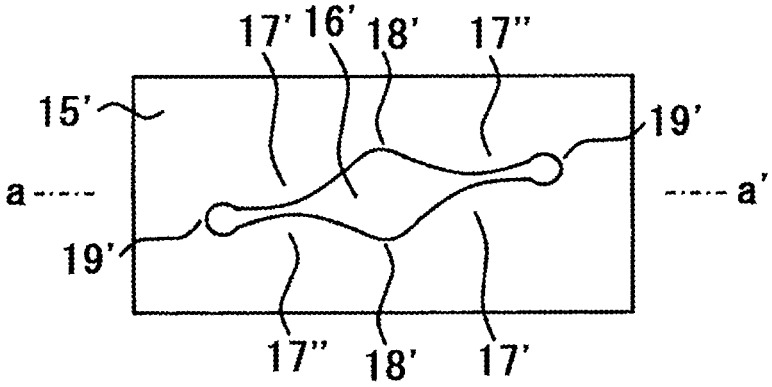
FIG. 18 is a diagram of an example of the sheet-removing opening of the present invention.
Figure 19:
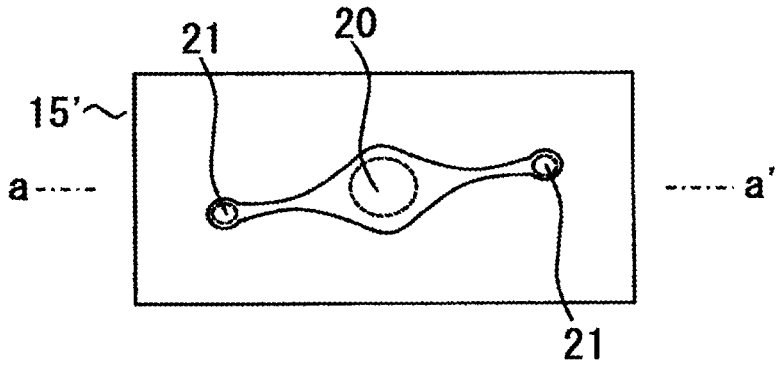
FIG. 19 is a diagram of an example of the sheet-removing opening of the present invention.
Figure 20:
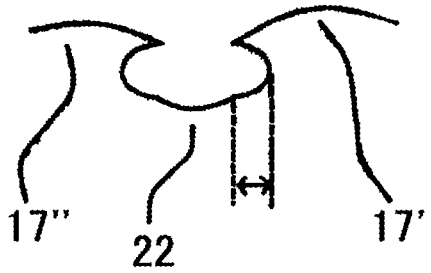
FIG. 20 is a diagram of an example of the sheet-removing opening of the present invention.
Figure 21:
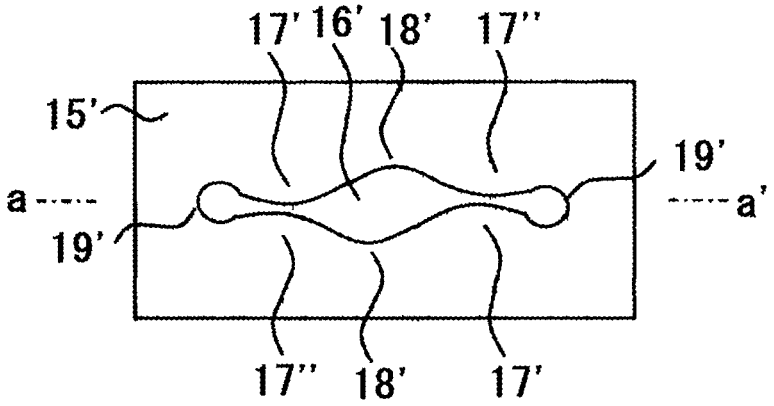
FIG. 21 is a diagram of an example of the sheet-removing opening of the present invention.
Figure 22:
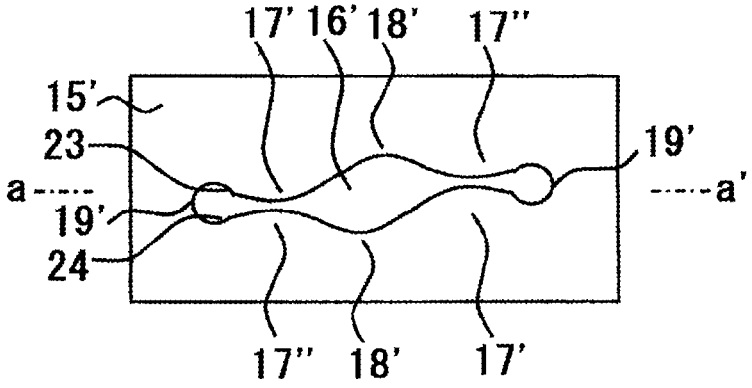
FIG. 22 is a diagram of an example of the sheet-removing opening of the present invention.
Figures 23A, 23B, 23C:
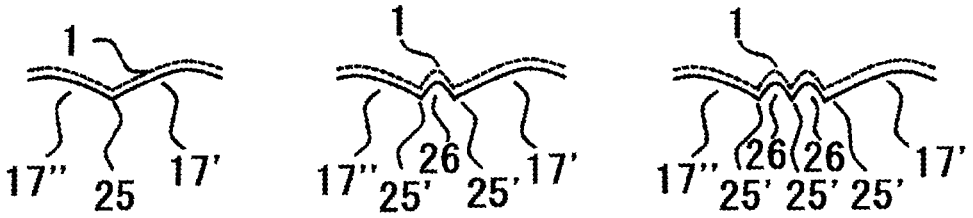
FIG. 23A is a diagram illustrating the rim of the opening mentioned in claim 2.
FIG. 23B is a diagram illustrating the rims of the opening mentioned in claim 4.
FIG. 23C is a diagram illustrating the rims of the opening mentioned in claim 4.
Figure 24:
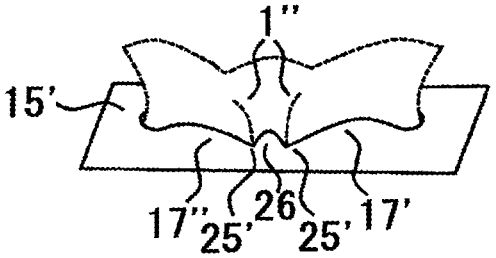
FIG. 24 is a diagram of an example of the operation of B of FIG. 23.
Figure 25:
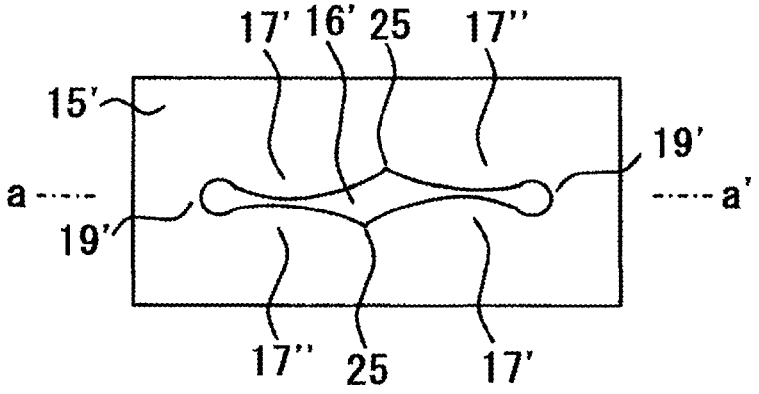
FIG. 25 is a diagram of an example of the sheet-removing opening of the present invention.
Figure 26:
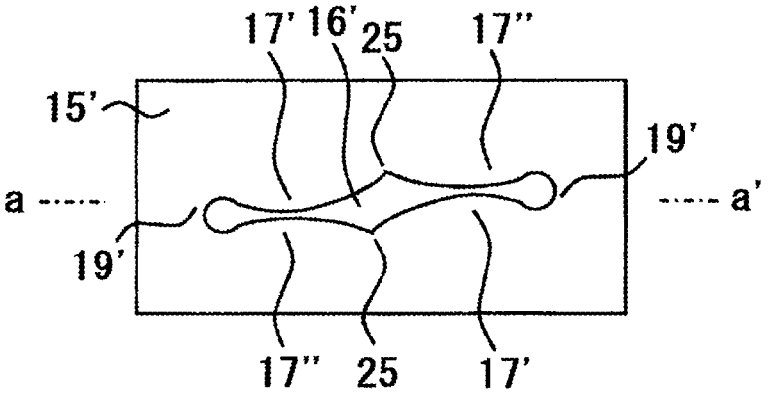
FIG. 26 is a diagram of an example of the sheet-removing opening of the present invention.
Figure 27:
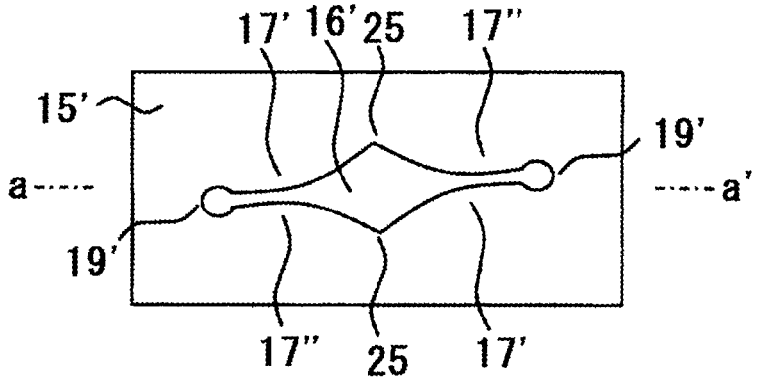
FIG. 27 is a diagram of an example of the sheet-removing opening of the present invention.
Figure 28:
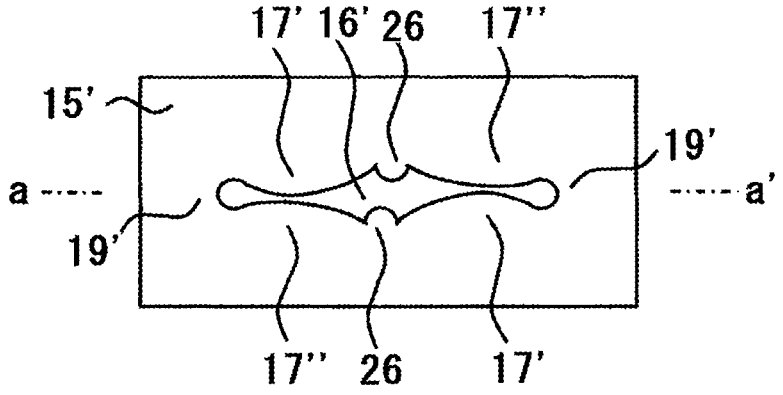
FIG. 28 is a diagram of an example of the sheet-removing opening of the present invention.
Figure 29:
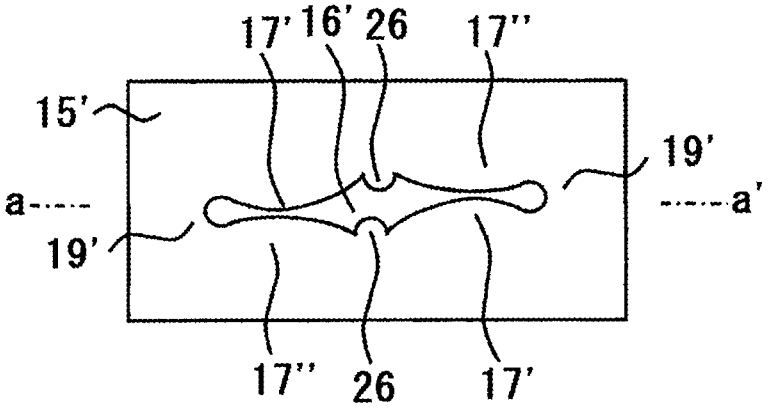
FIG. 29 is a diagram of an example of the sheet-removing opening of the present invention.
Figure 30:
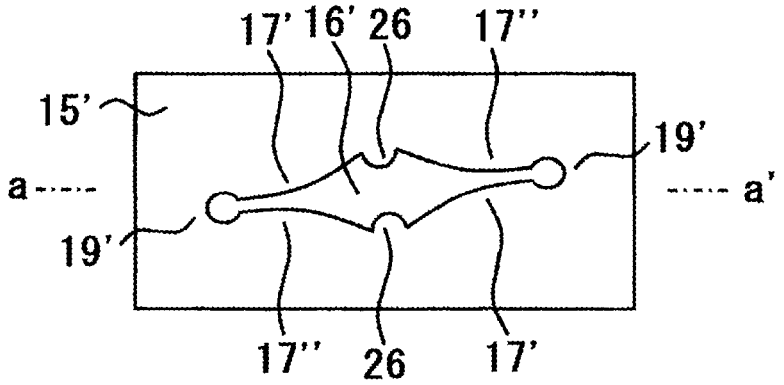
FIG. 30 is a diagram of an example of the sheet-removing opening of the present invention.
Figure 31:
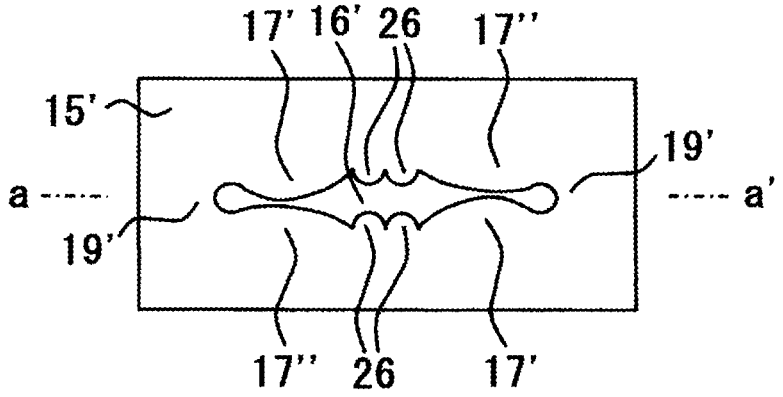
FIG. 31 is a diagram of an example of the sheet-removing opening of the present invention.
Figure 32:
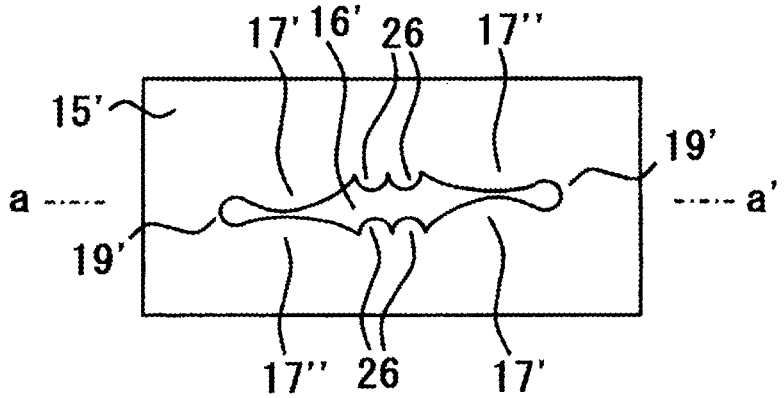
FIG. 32 is a diagram of an example of the sheet-removing opening of the present invention.
Figure 33:
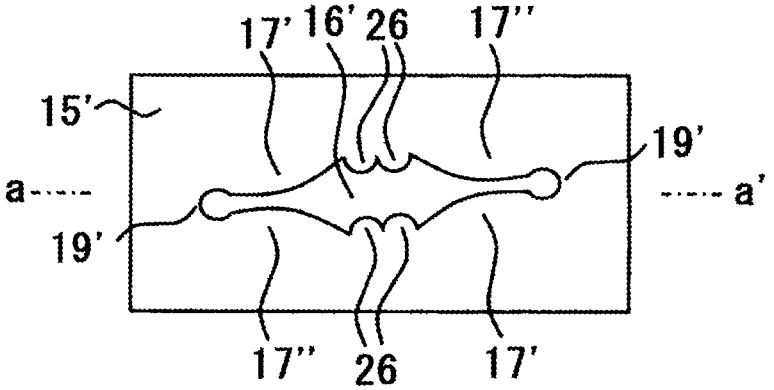
FIG. 33 is a diagram of an example of the sheet-removing opening of the present invention.
Figure 34:
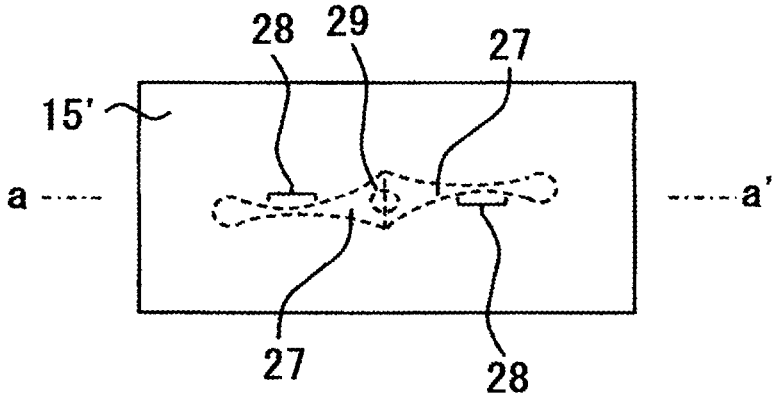
FIG. 34 is a diagram of an example of a top lid provided on the sheet-removing opening of the present invention.
Figure 35A:
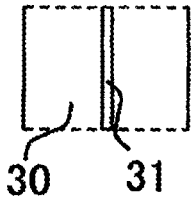
FIG. 35A is a diagram of a portion of a flattened storage box seen from the front side.
Figure 35B:
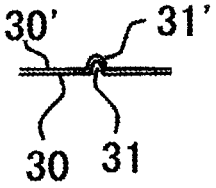
FIG. 35B is the cross sectional diagram of FIG. 35A.
Figure 35C:
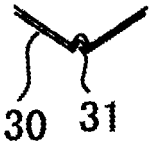
FIG. 35C is a diagram wherein, right and left inner surfaces of FIG. 35B are moved closer and fold down.
Figure 36A:
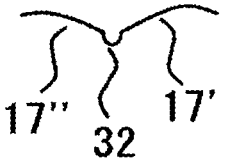
FIG. 36A is a diagram of the portion with a space between (17') and (17") changed to (32).
Figure 36B:
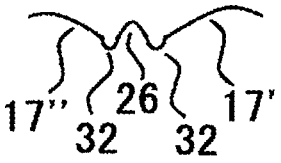
FIG. 36B is a diagram of the portion with (25') changed to (32).
Figure 36C:
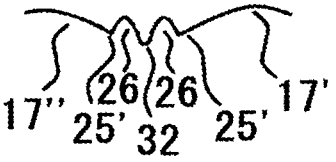
FIG. 36C is a diagram of the portion with (25') present between (26) changed to (32).
Figure 37:
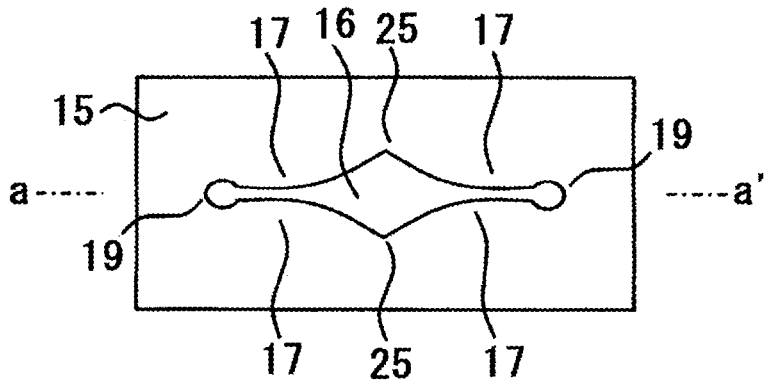
FIG. 37 is a diagram of an example of the sheet-removing opening with main projection having line symmetric position.
Figure 38:
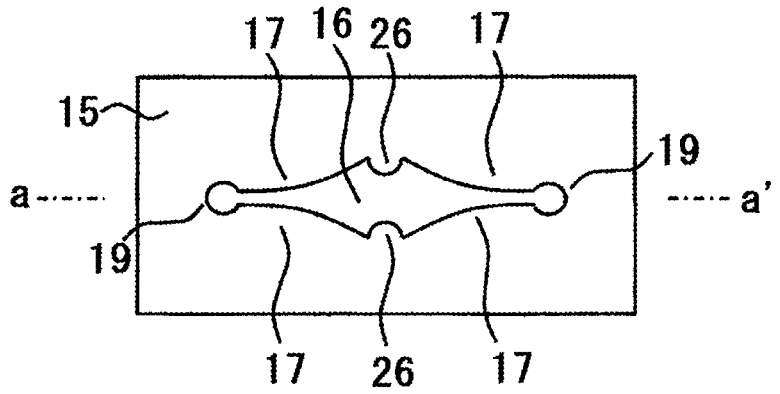
FIG. 38 is a diagram of an example of the sheet-removing opening with main projection having line symmetric position.
Figure 39:
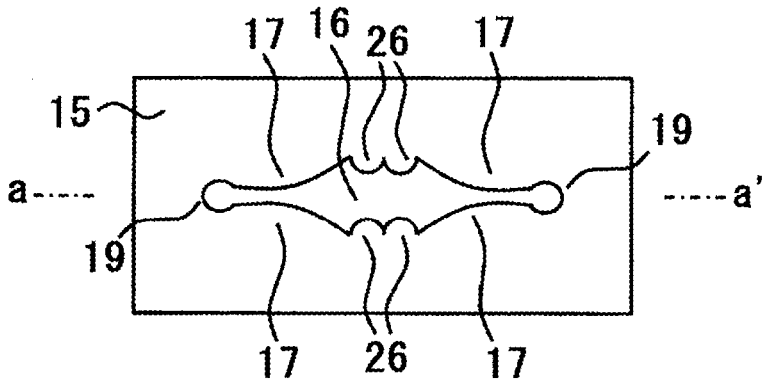
FIG. 39 is a diagram of an example of the sheet-removing opening with main projection having line symmetric position.
Figure 40A:
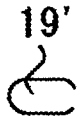
FIG. 40A shows the depression formed by is combining the curve shape and straight line shape.
Figure 40B:
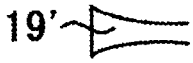
FIG. 40B shows the depression formed by changing the end of the rims of the opening to the straight line shape.
Figure 40C:
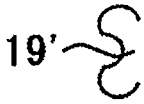
FIG. 40C shows the depression formed by the curved shape depression at both ends and the depression including the projection at the center.
Figure 41:
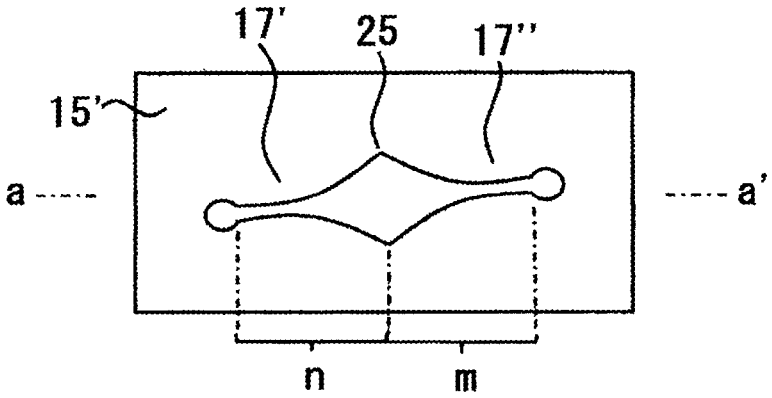
FIG. 41 is a diagram of an example of the sheet-removing opening of the present invention.

1: Sheet,
1': Folded line of a sheet
2: Surface with an opening
2': Top lid of the opening
3: Tissue-paper removing opening
3'*a* and 3'*b*: Rims of the opening
4: Fixing sheet pasted near the opening
5: Slit provided in the fixing sheet pasted near the opening
6, 6', 6": Projection for fixing the tissue paper
7: Nonlinear symmetric and point symmetric sheet-removing opening
7*a*: Long side of the opening
7*b*: Short side of the opening,
7L and 7R: Rims of the opening
8: Projection
9: Rims of the opening
10: Depression
11: Rims of the opening
12, 12', 12": Apex of the projection
13, 13': Projection forming the opening
14: Cover main body
14': Sheet-removing opening
15: Surface of the sheet-removing opening
15': Surface of the sheet-removing opening of the present invention
16: Sheet-removing opening
16': Sheet-removing opening of the present invention
17: Rims of the opening
17': Rim of the opening of the present invention with long height
17": Rim of the opening of the present invention with short height
18: Depression
18'; Depression of the present invention
19: Depression
19': Depression of the present invention
20: Open space within the circle of 3 mm at the center of the opening
21: Open space within the circle of 2 mm at both ends of the opening
22: Concave depression at lower portion of rim of the opening of the present invention with long height and rim of the opening of the present invention with short height
23: Step of rim of the opening of the present invention with long height and depression of the present invention
24: Step of rim of the opening of the present invention with short height and depression of the present invention
25: Folded line shape or folded convex shape curved depression
25': Depression formed adjacent to curved shape projection at lower level than the height of rim of the opening of the present invention with long height and rim of the opening of the present invention with short height
26: Curved shape projection at lower level than the height of rim of the opening of the present invention with long height and rim of the opening of the present invention with short height
27: Top lid that can be detached by using perforated line
28: Thin portion of the top lid
29: Circular top lid portion with perforated line
30: Front surface of the storage box
30': Inner surface of the box
31: Concave shape groove
31': Convex shape line
32: Smooth concave shape depression
A-A': Breadth of the storage box
B-B': Length of the storage box
C-C': Height of the storage box
d: Portion near the center of the opening, intersection of a-a' and b-b'
d': Circle near the center of the tissue-paper removing opening
a-a': Line parallel to the folding line of the sheet passing through the center of the opening
b-b': Straight line passing through the center of the opening perpendicular to a-a'
x: Hand
e and e': Portion of the tissue paper to which force is likely to be applied
s: Line parallel to b-b' and passing through the apex of the projection of the opening
t: Intersecting line perpendicular to line parallel to b-b' and passing through the apex of the projection of the opening
n, m: Ratio of rim of the opening of the present invention with long height and rim of the opening of the present invention with short height

What is claimed is:

1. A sheet storage box, wherein:

the sheet storage box is for storing sheets that are folded in a parallel or substantially parallel direction, the direction defining an average sheet fold line; and an open space is formed on a surface of the sheet storage box as a sheet-removing opening defined by a rim for removing sheets, the rim of the sheet-removing opening consisting of:

a first corner portion;
a second corner portion;
a third corner portion;
a fourth corner portion;
a first rim region connecting the first corner portion and the second corner portion;
a second rim region connecting the second corner portion and the third corner portion;
a third rim region connecting the third corner portion and the fourth corner portion; and
a fourth rim region connecting the fourth corner portion and the first corner portion;

wherein:

a line segment that connects the first corner portion and the third corner portion defines a first line segment;
a line segment that connects the second corner portion and the fourth corner portion defines a second line segment;
an intersection of the first line segment and the second line segment defines a center of the sheet-removing opening;

a line that is parallel or substantially parallel to the average sheet fold line and that passes through the center of the sheet-removing opening defines a third line segment;

the second corner portion is a concave shape curve projecting towards the outside of the sheet-removing opening from the center of the sheet-removing opening;

the fourth corner portion is a concave shape curve projecting towards the outside of the sheet-removing opening from the center of the sheet-removing opening;

the first rim region is a convex shape curve projecting towards the second line segment, the convex shape curve defining a shape and a size of the first rim region;

the second rim region is a convex shape curve projecting towards the second line segment, the convex shape curve defining a shape and a size of the second rim region;

the third rim region is a convex shape curve projecting towards the second line segment, the convex shape curve defining a shape and a size of the third rim region;

the fourth rim region is a convex shape curve projecting towards the second line segment, the convex shape curve defining a shape and a size of the fourth rim region;

the shape of the first rim region and the shape of the third rim region are point-symmetric with each other with respect to the center of the sheet-removing opening;

the shape of the second rim region and the shape of the fourth rim region are point-symmetric with each other with respect to the center of the sheet-removing opening;

the closest distance between the first rim region and the second line segment defines a first rim region distance;

the closest distance between the second rim region and the second line segment defines a second rim region distance;

the closest distance between the third rim region and the second line segment defines a third rim region distance;

the closest distance between the fourth rim region and the second line segment defines a fourth rim region distance;

the first rim region distance and the third rim region distance are the same or substantially the same as each other;

the second rim region distance and the fourth rim region distance are the same or substantially the same as each other;

the position of the first corner portion and the position of the third corner portion are point-symmetric with each other with respect to the center of the sheet-removing opening;

the first corner portion consists of two convex shape curves, both of which project towards the second line segment, the two convex shape curves defining first corner portion sizes;

the third corner portion consists of two convex shape curves, both of which project towards the second line segment, the two convex shape curves defining third corner portion sizes;

each of the first corner portion sizes is smaller than the size of the first rim region and the size of the fourth rim region;

each of the third corner portion sizes is smaller than the size of the second rim region and the size of the third rim region;

the shape of the entire sheet-removing opening is not line-symmetric with respect to the third line segment; and the shape of the entire sheet-removing opening is point-symmetric or substantially point-symmetric with respect to the center of the sheet-removing opening.

2. The sheet storage box according to claim 1, wherein:

the two convex shape curves of the first corner portion form an angle where they connect with each other;

the first corner portion and the first rim region form an angle where they connect with each other;

the second rim region and the third corner portion form an angle where they connect with each other;

the two convex shape curves of the third corner portion form an angle where they connect with each other;

the third corner portion and the third rim region form an angle where they connect with each other; and the fourth rim region and the first corner portion form an angle where they connect with each other.

* * * * *